US009524837B2

(12) United States Patent
Froebel et al.

(10) Patent No.: US 9,524,837 B2
(45) Date of Patent: Dec. 20, 2016

(54) ELECTRICAL CONTACT ARRANGEMENT

(75) Inventors: Sascha Froebel, Berlin (DE); Rene Guenther, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 465 days.

(21) Appl. No.: 13/991,284

(22) PCT Filed: Nov. 15, 2011

(86) PCT No.: PCT/EP2011/070124

§ 371 (c)(1),
(2), (4) Date: Jun. 3, 2013

(87) PCT Pub. No.: WO2012/072410

PCT Pub. Date: Jun. 7, 2012

(65) Prior Publication Data

US 2013/0248492 A1 Sep. 26, 2013

(30) Foreign Application Priority Data

Dec. 2, 2010 (DE) ..... 10 2010 062 343

(51) Int. Cl.

| | |
|---|---|
| ***H01H 1/06*** | (2006.01) |
| ***H01H 33/12*** | (2006.01) |
| ***H01H 1/38*** | (2006.01) |
| ***H01R 13/24*** | (2006.01) |
| *H01R 13/187* | (2006.01) |
| *H01R 13/453* | (2006.01) |

(52) U.S. Cl.

CPC ..... *H01H 33/12* (2013.01); *H01H 1/385* (2013.01); *H01R 13/2421* (2013.01); *H01R 13/187* (2013.01); *H01R 13/4538* (2013.01)

(58) Field of Classification Search

CPC ..... H01H 1/5866; H01H 1/38; H01H 1/385
USPC ..... 200/275, 253.1, 51.09, 51.11, 51.12; 218/16–21, 7, 14, 153, 154, 53, 63, 72
See application file for complete search history.

(56) References Cited

U.S. PATENT DOCUMENTS

| | | | | |
|---|---|---|---|---|
| 3,789,175 | A | 1/1974 | Beier et al. | |
| 4,181,837 | A * | 1/1980 | Browne, Jr. | 218/48 |
| 4,996,398 | A | 2/1991 | Dufournet et al. | |
| 5,001,314 | A | 3/1991 | Thuries et al. | |
| 5,258,590 | A | 11/1993 | Dufournet et al. | |
| 2011/0120975 | A1 * | 5/2011 | Nufer et al. | 218/63 |

FOREIGN PATENT DOCUMENTS

| | | |
|---|---|---|
| CA | 2113097 A1 | 1/1993 |
| CH | 519 773 A | 2/1972 |
| CN | 1042445 A | 5/1990 |
| CN | 1050286 A | 3/1991 |

(Continued)

*Primary Examiner* — Renee Luebke
*Assistant Examiner* — Lheiren Mae A Caroc
(74) *Attorney, Agent, or Firm* — Laurence Greenberg; Werner Stemer; Ralph Locher

(57) ABSTRACT

An electrical contact configuration includes a first contact piece with a contact socket and a second contact piece which can move relative to the first contact piece. The second contact piece has a complementary shape to the first contact piece. An auxiliary contact piece is guided in such a way that it can move in the contact socket of the first contact piece. The auxiliary contact piece is guided in an electrically isolated manner.

12 Claims, 3 Drawing Sheets

(56) References Cited

FOREIGN PATENT DOCUMENTS

| | | | |
|---|---|---|---|
| CN | 1069363 | A | 2/1993 |
| DE | 9108589 | U1 | 9/1991 |
| EP | 0525716 | A1 | 2/1993 |
| EP | 2221844 | A1 | 8/2010 |
| JP | 10308143 | A | 11/1998 |
| JP | H11176301 | A | 7/1999 |
| WO | 9301604 | A1 | 1/1993 |

* cited by examiner

ELECTRICAL CONTACT ARRANGEMENT

BACKGROUND OF THE INVENTION

Field of the Invention

The invention relates to an electrical contact arrangement having a first contact piece which has a contact socket having a second contact piece which has a complementary shape to and can move relative to the first contact piece, and having an auxiliary contact piece which is guided such that it can move in the contact socket.

By way of example, an electrical contact arrangement such as this is known from Japanese laid-open specification JP-10 308143. The electrical contact arrangement there has a first and a second contact piece, with an auxiliary contact piece being guided such that it can move in a contact socket in the first contact piece. The auxiliary contact piece slides in the contact socket.

Guidance is in this case provided via a guide rod which surrounds the auxiliary contact piece and passes through the first contact piece, such that it can move, in the bottom area of the contact socket. A bearing is provided for the guide rod in a relatively short section.

Tilting of the guide rod can be prevented only in conjunction with the auxiliary contact piece. The auxiliary contact piece is therefore used on the one hand for mechanical guidance and on the other hand for making electrical contact. The surfaces which are provided for making electrical contact are therefore subject to electrical loads on the one hand, and mechanical loads on the other hand.

The electrical characteristics can be disadvantageously influenced by mechanical wear. Conversely, the operation of the mechanism can be disadvantageously influenced by electrical effects.

BRIEF SUMMARY OF THE INVENTION

The object of the invention is therefore to specify an electrical contact arrangement which reduces the possibilities of electrical and mechanical functions influencing one another on the electrical contact arrangement.

According to the invention, the object is achieved in the case of an electrical contact arrangement of the type mentioned initially in that the auxiliary contact piece is guided in an electrically isolated manner.

Electrical contact arrangements having a first and a second contact piece which can move relative to one another are used in order to break current paths and to make current paths in electrical switching devices. When the two contact pieces move relative to one another, a current path can be made by direct or indirect contact being made between the two contact pieces. The contact pieces which make contact with one another can be disconnected in order to break a current path. In an embodiment of the first contact piece with a contact socket, it is advantageously possible for this contact socket to be equipped with a contact arrangement which, when the contact arrangement is in the connected state, is seated on an outer casing surface of a second contact piece which has a complementary shape to the contact socket. The two contact pieces should advantageously be movable relative to one another along a line, thus allowing the second contact piece to be inserted into the contact socket in the first contact piece without being tilted. An auxiliary contact piece which is guided such that it can move in the contact socket makes it possible for the two contact pieces to first of all make contact with one another via interposition of the auxiliary contact piece. A movement axis of the auxiliary contact piece should preferably run parallel to the movement axis of the contact pieces which can move relative to one another. This allows the contact socket to be protected against influences of arcing phenomena, such as those which occur when the contact pieces are disconnected or make contact. It is advantageous in this case for the auxiliary contact piece to be equipped, for example, with an area composed of erosion-resistant material. An erosion-resistant material has greater resistance to arcing phenomena than further contact pieces which are used to form the contact pieces.

If electrically isolated guidance is provided for the auxiliary contact piece, then arcing phenomena can be deliberately concentrated on the auxiliary contact piece. This makes it possible for the auxiliary contact piece to provide a protective effect for the first contact piece. Furthermore, the electrically isolated guidance makes it possible to prevent creation of straight current paths. This makes it possible to prevent discharge phenomena in a mechanism which is used for guidance of the auxiliary contact piece. Electrically isolating guidance suppresses such straight current paths.

A further advantageous refinement allows the auxiliary contact piece to be guided in an insulating arrangement which is held by the contact socket.

An insulating arrangement which is arranged in the contact socket is, for example, inserted into the contact socket on an interior of the casing. This makes it possible for an auxiliary contact piece to rest on the insulating arrangement, on the casing side. By way of example, insulating sleeves or linings in places (for example skids or points) can be used as an insulating arrangement on a casing area of the contact socket. By way of example, the insulating arrangement may have surfaces composed of plastic, on which the auxiliary contact piece rests and which have an electrically insulating effect. By way of example, polyethylenes or similar plastics are suitable as plastics. Plastics allow low-friction guidance of the auxiliary contact piece, thus allowing the auxiliary contact piece to move freely. Furthermore, guidance of the auxiliary contact piece on the casing side is advantageous in order to prevent the auxiliary contact piece from tilting or canting in the insulating arrangement.

Furthermore, it is advantageously possible for the auxiliary contact piece to make electrically conductive contact with the first contact piece via a contact arrangement, at least in a disconnected state of the contact pieces.

Depending on relative movement of the two contact pieces with respect to one another, the auxiliary contact piece moves in its guide in the contact socket in the first contact piece. The auxiliary contact piece and the first contact piece are at the same potential when the auxiliary contact piece is guided in an electrically isolated manner and contact is made with the first contact piece. However, because of the isolated guidance of the auxiliary contact piece, no potential transfer takes place via the mechanism which is intended for guidance of the auxiliary contact piece. Instead of this, a defined contact-making path, located outside the isolating guidance, is formed between the auxiliary contact piece and the first contact piece, resulting in potential being transferred between the first contact piece and the auxiliary contact piece without straight current paths being formed via the mechanism for guidance. In this case, the contact arrangement can result in indirect contact being made between the auxiliary contact piece and the first contact piece, thus resulting in contact being made with a low contact resistance. No electrical fields can be formed between the first contact piece and the auxiliary contact piece, because they are at the same potential. An area without any field is thus formed between the auxiliary contact piece and the first contact piece. In particular, if the auxiliary contact piece is appropriately configured, the contact socket can itself be kept free of fields.

A further advantageous refinement allows the contact arrangement to make direct contact with the auxiliary contact piece or the second contact piece depending on a switching state of the electrical contact arrangement.

Direct contact between the auxiliary contact piece or the second contact piece with the contact arrangement makes it possible to use the contact arrangement to form a contact-making path, both in the connected state and in the disconnected state of the electrical contact arrangement. For example, this means that it is possible for direct electrical contact to be made between the first and the second contact pieces via the contact arrangement in the connected state. In the disconnected state, that is to say when the two contact pieces are galvanically isolated, the contact arrangement can be used to make direct contact with the auxiliary contact piece. The contact arrangement can therefore carry out different tasks in different switching states. When the electrical contact arrangement is in the connected state, the contact arrangement is used as part of the current path which is formed between the first and the second contact pieces. In the disconnected state of the electrical contact arrangement, the contact arrangement is used to transfer electrical potential from the first contact piece to the auxiliary contact piece. This makes it possible on the one hand to provide electrically isolated guidance for the auxiliary contact piece and to ensure potential transfer via the contact arrangement, without any need for additional contact elements as well as the contact arrangement, since said contact arrangement makes a contact-making path both in the connected state and in the disconnected state.

Direct contact in this case provides for the contact arrangement to directly connect to one another on the one hand the first contact piece and on the other hand the auxiliary contact piece, or on the one hand the first contact piece and on the other hand the second contact piece, in order to form a contact-making path. A direct contact reduces the number of series-connected contact points, thus limiting the contact resistance. It is also possible for a direct contact to be made between the first contact piece and the auxiliary contact piece and the second contact piece at the same time while changing from one switching state to the other switching state. Direct contact of the first and the second contact pieces and the auxiliary contact piece can be utilized to allow the auxiliary contact piece to be disconnected from or connected in a current path, which is formed between the first and the second contact pieces, without any interruption.

A further advantageous refinement allows a guide element which limits movement capability of the auxiliary contact piece to pass through the auxiliary contact piece.

If a guide element is used, this makes it possible to define the movement path of the auxiliary element. By way of example, this makes it possible to allow electrically isolated guidance of the auxiliary contact piece by means of an insulating arrangement, and to limit the movement capability of the auxiliary contact piece via the guide element. The guide element is therefore used as a limiting element for the auxiliary contact piece. The limiting element prevents the auxiliary contact piece from being released from the contact socket. If required, it is also possible for the electrically isolating guidance of the auxiliary contact piece on its own to ensure its guidance.

The guide element makes it harder for the auxiliary contact piece to be released in an unstructured manner.

The guide element can act as a stop, such that the movement capability of the auxiliary contact piece is limited by the guide element itself. When the auxiliary contact piece moves in the direction of a socket opening in the contact socket, the guide element prevents the auxiliary contact piece from moving out of the contact socket. For this purpose, the guide element may have a stop which the auxiliary contact piece strikes, thus limiting movement of the auxiliary contact piece. In this case, it is possible for the auxiliary contact piece to be arranged such that it is electrically isolated from the guide element, and such that a direct electrically conductive connection is formed between the guide element and the auxiliary contact piece only when touching the guide element stop. By way of example, the auxiliary contact piece may surround the guide elements with a form of clearance fit, thus ensuring there is adequate separation between the guide element and the surrounding auxiliary contact piece for electrical isolation. A projecting body edge on the guide element can act as a stop for the auxiliary contact piece, in which case contact may already have been made between the guide element and the auxiliary contact piece via an electrically conductive path at the moment when the auxiliary contact piece strikes the stop on the guide element.

A further advantageous refinement allows the auxiliary contact piece to be spring-loaded and to have an annular groove for holding a spring.

Spring loading assists fixing of the auxiliary contact piece in a limit position. It is therefore impossible for the auxiliary contact piece to carry out a movement spontaneously. The auxiliary contact piece can be moved against the force produced by a spring. A spring may, for example, be held in an annular groove on the auxiliary contact piece. It is therefore possible to introduce spring forces distributed symmetrically into the auxiliary contact piece and to apply a spring force to the auxiliary contact piece which spring force is as linear as possible and acts in the direction of the movement axis of the auxiliary contact piece. By way of example, an annular groove may have a rectangular cross section, with the annular groove having an intrinsically closed circumference. The spring may be in the form of a helical spring, which is aligned coaxially with respect to the annular groove and rests on a groove base of the annular groove.

In this case, it is also possible for the annular groove to clasp the guide element.

If the guide element is clasped by the annular groove, this makes it possible for the guide element to likewise pass through the spring. Force can therefore be introduced into the auxiliary contact piece parallel to its movement direction. It is possible for the auxiliary contact piece to be moved along a movement axis at a distance from the guide element. By way of example, movement of the auxiliary contact piece can be initiated by insertion of the second contact piece into the contact socket. In this case, the second contact piece moves through the socket opening into the contact socket, and moves the auxiliary contact piece along the guide element in the direction of a base of the contact socket, which faces away from the socket opening. For this purpose, for example, the guide element may be arranged centrally in the contact socket.

Furthermore, it is advantageously possible for the auxiliary contact piece to have an annular contact-making area which has a complementary shape to an annular contact-pressure area on the second contact piece.

During a connection process, a leading contact can initially be made between an annular contact-making area of the auxiliary contact piece and the contact-pressure area of the second contact piece, as a result of which a current path is first of all formed between the first and the second contact piece, with the interposition of the auxiliary contact piece. In the event of arcing phenomena, this therefore ensures that erosion phenomena occur first of all on the auxiliary contact piece, in particular on its annular contact-making area and the contact-pressure area of the second contact piece. If an annular contact-pressure area of the second contact piece has a complementary shape, the annular contact-making area of the auxiliary contact piece can be used to carry out a movement of the auxiliary contact piece, resulting from a relative movement of the contact pieces with respect to one another, and to move the auxiliary contact piece in the direction of the base of the contact socket. When the contact-making area on the auxiliary contact piece and the contact-pressure area on the second contact piece make contact, this results in a direct electrical contact between the auxiliary contact piece and the first contact piece while, in contrast, electrical contact between the first and the second contact pieces is made indirectly via the interposed auxiliary contact piece.

As the movement of the second contact piece progresses, that is to say at a start of movement of the auxiliary contact piece, the auxiliary contact piece is moved in the direction of the base of the contact socket, which subsequently results in switching of the direct electrical contact between the first contact piece and the auxiliary contact piece to direct contact between the first contact piece and the second contact piece. The interposed auxiliary contact piece is therefore removed from the current path between the two contact pieces of the electrical contact arrangement, and is no longer part of the current path between the first and the second contact piece. Although there is still a direct contact between the auxiliary contact piece and the second contact piece, and an indirect contact with the first contact piece, all that occurs, however, is that the electrical potential is transferred to the auxiliary contact piece. The electrically isolated guidance of the auxiliary contact piece prevents parallel current paths via the auxiliary contact piece and its mechanical guidance. After switching, the auxiliary contact piece is itself no longer part of the current path formed by the electrical contact arrangement between the first and the second contact pieces. In this case, switching can take place without interruption. Conversely, when the electrical contact arrangement is disconnected, the auxiliary contact piece can be interposed between the existing direct contact between the two contact pieces, thus resulting in direct contact between the two contact pieces via the auxiliary contact piece. This switching can also be carried out without interruption. This ensures therefore, when the current path to be opened is interrupted, arcing phenomena occur between the contact-making area of the auxiliary contact piece and the contact-pressure area of the second contact piece.

When the electrical contact arrangement is in the disconnected state, the auxiliary contact piece can pass through the socket opening in the first contact piece in the direction of the second contact piece, thus ensuring that, when the second contact piece moves in the direction of the contact socket in the first contact piece, the second contact piece strikes the auxiliary contact piece first of all. Conversely, during a disconnection process, the current path is disconnected between the auxiliary contact piece and the second contact piece. Arcing phenomena are therefore concentrated on the contact-making area and the contact-pressure area.

Furthermore, it is advantageously possible to provide for the second contact piece to have a guide socket which moves onto the guide element during a connection process.

A guide socket in the second contact piece allows the guide element in the contact socket in the first contact piece to be used to stabilize the electrical contact arrangement. It is therefore possible to guide the second contact piece on the guide element, and to make electrical contact between the contact socket and an outer casing of the second contact piece. An appropriate separation can be provided between those surfaces on the outside of the casing and on the inside of the casing of the second contact piece and the contact socket in the first contact piece, thus allowing a contact arrangement which is arranged there to be elastically deformed, and ensuring adequate contact-pressure forces on an inner casing surface of the contact socket in the first contact piece, and on an outer casing surface of the second contact piece. Use of the guide element for guidance of the second contact piece prevents elastically deformable areas of the contact arrangement against impermissible deformation resulting from tilted insertion of the second contact piece into the contact socket. For example, this means that it is possible to ensure a coaxial position without any tilting between the two contact pieces.

The guide element carries out two tasks in the electrical contact arrangement, on the one hand forming a stop for the auxiliary contact piece in order to limit the movement capability of the auxiliary contact piece. On the other hand, the guide element forms a holder, in order to prevent the second contact piece from tilting when it has been inserted into the contact socket. In this case, the second contact piece can move directly onto the guide element, thus fixing the relative coaxial position between the contact pieces during a relative movement between said two contact pieces.

A further advantageous refinement allows the guide socket to have a radially projecting guidance element.

An arrangement of a radially projecting guidance element in the interior of the guide socket makes it possible to limit the contact area of the guide socket on the guide element to the projecting guidance element. This on the one hand can make the second contact piece, which moves onto the guide element, mechanically robust. On the other hand, this reduces the sliding friction that occurs. Both electrically conductive and electrically insulating guidance elements can be used as guidance elements, for example in the form of a ring which constricts the guide socket. An annular guidance element projects radially into the cross section of the guide socket in the second contact piece. Plastic rings, which are used as a guidance element, have been found to be particularly suitable for this purpose.

Furthermore, it is advantageous for the mutually touching areas of the auxiliary contact piece and of the second contact piece to have an erosion-resistant coating.

An erosion-resistant coating has more resistance to arcing phenomena than further contact materials of the first and second contact pieces. The use of an erosion-resistant coating on the mutually touching areas of the auxiliary contact piece and of the second contact piece, that is to say on the annular contact-making area and on the annular contact-pressure area of the second contact piece, which has a complementary shape to the annular contact-making area, on the one hand provides a defined surface which is resistant to arcing phenomena. An erosion-resistant coating such as this may also have adequate mechanical resistance, such that mechanical forces can be absorbed by it. In particular, the erosion-resistant coating may also be used for force transmission, in order to move the auxiliary contact piece against the spring force of the spring which spring-loads the auxiliary contact piece.

A further advantageous refinement allows the auxiliary contact piece to close the contact socket.

Using the auxiliary contact piece to close the contact socket allows the socket opening to be dielectrically shielded. The contact arrangement, which is arranged in the contact socket, may have a dielectrically poor shape and could promote distortion of an electrical field despite the arrangement within the contact socket, can thus be shielded. In addition to using the auxiliary contact piece for shielding the contact socket, closing the socket, opening in the contact socket also mechanically protects the contact arrangement. This therefore makes it more difficult for mechanical forces to act directly on the contact socket, and to become dirty.

Furthermore, it is advantageously possible for the auxiliary contact piece together with the guide element to close the contact socket.

If the guide element and the auxiliary contact piece together close the contact socket, it is possible in this way for an annular space to be arranged around the guide element in the contact socket, which annular space is used to hold the auxiliary contact piece. The auxiliary contact piece should have an essentially annular or essentially hollow-cylindrical contour. The auxiliary contact piece is moved in the direction of the longitudinal axis of the guide element, or of the longitudinal axis of the contact socket, with the guide element being used to guide the second contact piece.

It is also advantageously possible for the contact arrangement to be an elastically deformable contact ring which is guided in a groove in the contact socket.

The use of an elastically deformable contact ring as a contact arrangement in a groove in the contact socket makes it possible to provide a multiplicity of contact-making points between the first and the second contact pieces in a small area. Contact rings can be designed in various ways. For example, it is possible to bend a helical spring in an annular shape, as a result of which the multiplicity of turns of the helical spring result in a corresponding number of contact-making points between the first and the second contact pieces, and between the first contact piece and the auxiliary contact piece. Furthermore, it is also possible to use contact rings which have correspondingly projecting contact fingers or contact laminates, which can make direct electrical contact with the first contact piece and the auxiliary contact piece, or with the first contact piece and the second contact piece. The groove in the contact socket should be concentrically circumferential around the longitudinal axis of the contact socket, and should in this case also clasp the guide element. The groove cross section should be latched to the shape of the contact ring that is used. For example, groove cross sections may be used having a dovetail shape, a rectangular shape, a trough shape, etc. The contact ring will in this case be inserted resiliently into the groove, in such a way that the spring elasticity of the contact ring is used on the one hand to make electrical contact between the two contact pieces. On the other hand, the resilient force of the contact ring may, however, also be used to position the contact ring in an interlocking manner in the socket, and to prevent the contact ring from being released radially and/or axially from the contact socket.

One exemplary embodiment of the invention will be described in more detail in the following text and is illustrated schematically in a drawing, in which:

DESCRIPTION OF THE INVENTION

Figure 1:
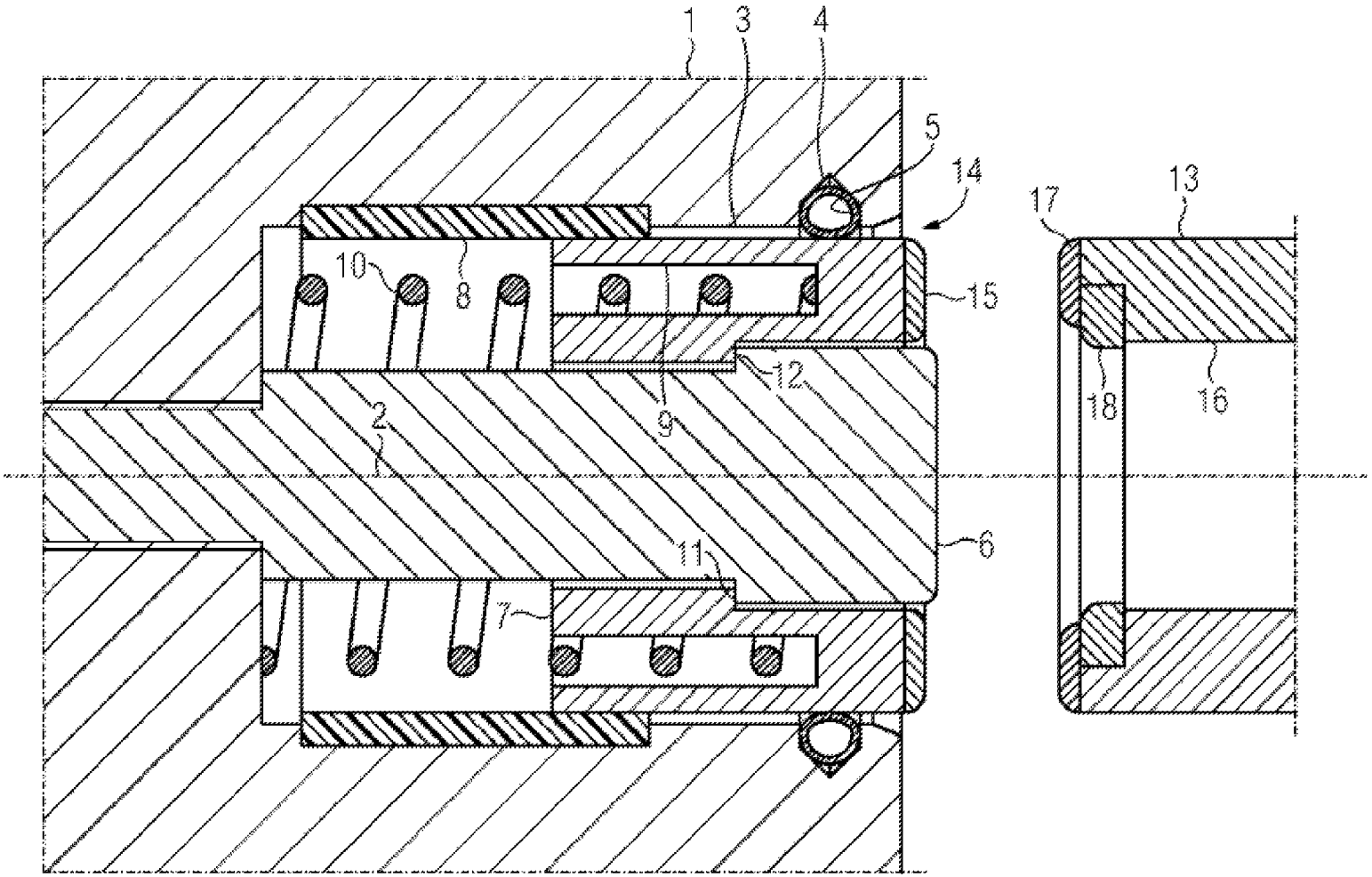
FIG. 1 shows a first and a second contact piece of a contact arrangement in the disconnected state.

FIG. 1 shows a section through a first contact piece 1. The first contact piece 1 is aligned essentially coaxially with respect to a longitudinal axis 2. The first contact piece 1 has a contact socket 3 with an essentially circular cross section. The contact socket 3 is aligned essentially coaxially with respect to the longitudinal axis 2 and has an inner wall in which a groove 4 is incorporated. The groove 4 is used to hold a contact arrangement 5 in the form of a contact ring. The contact arrangement 5 is in the form of an intrinsically closed helical spring running in a circular shape. The contact arrangement 5 is inserted resiliently into the groove 4. The contact socket 3 has a contact socket opening 14 on one end face.

A rotationally symmetrical guide element 6 passes centrally through the contact socket 3. The guide element 6 is screwed in a base of the contact socket 3 via a thread, such that the guide element 6 extends coaxially with respect to the longitudinal axis 2. The space which is bounded between the guide element 6 and the contact socket 3 is used to hold an auxiliary contact piece 7. The auxiliary contact piece 7 has an essentially hollow-cylindrical shape. In this case, the auxiliary contact piece 7 is borne such that it can move along the longitudinal axis 2 in the contact socket 3. The auxiliary contact piece 7 is borne in an electrically isolated manner in the contact socket 3. For this purpose, the contact socket 3 is equipped with an insulating arrangement 8 which is used for resting on an outer casing surface of the auxiliary contact piece 7. The insulating arrangement 8 separates an outer casing surface of the auxiliary contact piece 7 from an inner casing surface of the contact socket 3. The contact arrangement 5 projects beyond the groove 4 into a gap which is formed between the inner casing surface and the outer casing surface. The gap is an annular gap, which is aligned coaxially with respect to the longitudinal axis 2. In the present case, the insulating arrangement 8 is in the form of an insulating sleeve, on whose inner casing surface an outer casing surface of the auxiliary contact piece 7 rests. The outer casing surface of the insulating arrangement 8 is in turn fitted into an inner casing surface of the contact socket 3, and rests thereon. Alternatively, the insulating arrangement 8 may also have only point contact points for the auxiliary contact piece. The insulating arrangement may therefore have corresponding ribs, which project into the contact socket 3, or projections of any other desired shape, which prevent the auxiliary contact piece 7 from directly touching the first contact piece 1 in the area of the guidance of the auxiliary contact piece 7, while allowing axial movement of the auxiliary contact piece 7. In an equivalent manner, the insulating arrangement may also be borne at a fixed angle on the auxiliary contact piece 7, or may be movable relative to the contact socket 3 and relative to the auxiliary contact piece 7.

An annular groove 9 with an intrinsically closed circumference is introduced into the auxiliary contact piece 7 on that side of the auxiliary contact piece 7 which faces the base of the contact socket 3. In the present case, the annular groove 9 has a rectangular cross section, and runs in an intrinsically closed form, coaxially around the longitudinal axis 2. The annular groove 9 also clasps the guide element 6. A spring 10 in the form of a helical spring is placed in the annular groove 9 and is supported on the one hand on the groove base of the annular groove 9, and on the other hand on the base of the contact socket 3. The spring 10 is preloaded such that the auxiliary contact piece 7 is forced by the base of the contact socket 3 in the direction of the contact socket opening 14 in the contact socket 3. In order to prevent the auxiliary contact piece 7 from being released from the contact socket 3, the guide element 6 is used as a limiting element, in order to limit the movement capability of the auxiliary contact piece 7. For this purpose, the guide element 6 has a radially circumferential projecting shoulder 11. A shoulder 12, which projects radially inward on the auxiliary contact piece 7, presses against the projecting shoulder 11 of the guide element 6. Electrical contact is made between the guide element 6 and the auxiliary contact piece 7 via the two shoulders 11, 12 on them. Furthermore, when the two shoulders 11, 12 on the auxiliary contact piece 7 and on the guide element 6 abut against one another, electrical contact is already made via the contact arrangement 5 between the auxiliary contact piece 7 and the first contact piece 1.

The contact arrangement 5, which is located in the groove 4, is pressed onto an outer casing surface of the auxiliary contact piece 7, and the outer casing surface of the auxiliary contact piece 7 makes direct contact with the first contact piece 1. This results in a direct contact between the auxiliary contact piece 7 and the first contact piece 1. However, the auxiliary contact piece 7 is guided in an electrically isolated manner in the insulating arrangement. The insulating arrangement 8 prevents parallel current paths from being formed in the mechanical guidance of the auxiliary contact piece 7 to the current path which is formed via the contact arrangement 5.

The guide element 6 passes centrally through the contact socket opening 14. The auxiliary contact piece 7 is arranged in the contact socket 3, in the annular gap which remains between the guide element 6 and the first contact piece 1.

The auxiliary contact piece 7 closes the contact socket 3. An annular contact-making area 15 is provided at that end of the auxiliary contact piece which faces away from the base of the contact socket 3. The annular contact-making area 15 on the auxiliary contact piece 7 overhangs the socket opening 14 in the direction of a second contact piece 13, which is axially opposite the first contact piece 1. The annular contact-making area 15 on the auxiliary contact piece 17 is covered with an erosion-resistant coating.

The second contact piece 13 has a complementary shape to the contact socket 3. The second contact piece 13 is in the form of a bolt. Furthermore, the second contact piece 13 has a guide socket 16, in order to be moved onto the guide element 6, which is located centrally in the contact socket 3 in the first contact piece 1. At the end facing the first contact piece 1, the second contact piece 13 is equipped with an annular contact-pressure area 17 on the end face. The annular contact-pressure area 17 has an erosion-resistant coating and has a complementary shape to the annular contact-making area 15 on the auxiliary contact piece 7. Furthermore, the guide socket 16 is equipped with a radially projecting guidance element 18. The guidance element 18 is in the present case an electrically insulating ring which is inserted into a recess in the guide socket 16. The ring is elastically deformable and is used for pushing onto a casing surface of the guide element 6 of the first contact piece 1.

In the switching state of the electrical contact arrangement shown in FIG. 1, the first contact piece 1 and the second contact piece 13 are separated from one another (disconnected state), that is to say the first and the second contact pieces 1, 13 do not make a conductive contact. A relative movement is required between the first contact piece 1 and the second contact piece 13 along the longitudinal axis 2 in order to make an electrically conductive current path between the first contact piece 1 and the second contact piece 13. A relative movement such as this makes it possible to change from the "open" switching state as shown in FIG. 1 (disconnected state) to the "closed" switching state (connected state). By way of example, in order to produce a relative movement, the second contact piece 13 can be moved, in the direction of the first contact piece 1 along the longitudinal axis 2, driven by a drive apparatus which is not illustrated in FIG. 1.

When the second contact piece 13 moves toward the first contact piece 1, an end-face contact is first of all made between the annular contact-making area 15 and the annular contact-pressure area 17 of the second contact piece 13. As the movement progresses, the auxiliary contact piece 7 is moved in the direction of the base of the contact socket 3, along the longitudinal axis 2, against the spring force of the spring 10.

Electrical discharge phenomena, such as connection arcs or disconnection arcs, for example, occur between the annular contact-making area 15 and the annular contact-pressure area 17 because the initial contact is made between the annular contact-pressure area 17 and the annular contact-making area 15, which is in each case equipped with an erosion-resistant coating. When the contact-making area 15 and the contact-pressure area 16 touch, an indirect electrical contact is made between the first and the second contact pieces 1, 13 via the interposed auxiliary contact piece 7.

Figure 2:
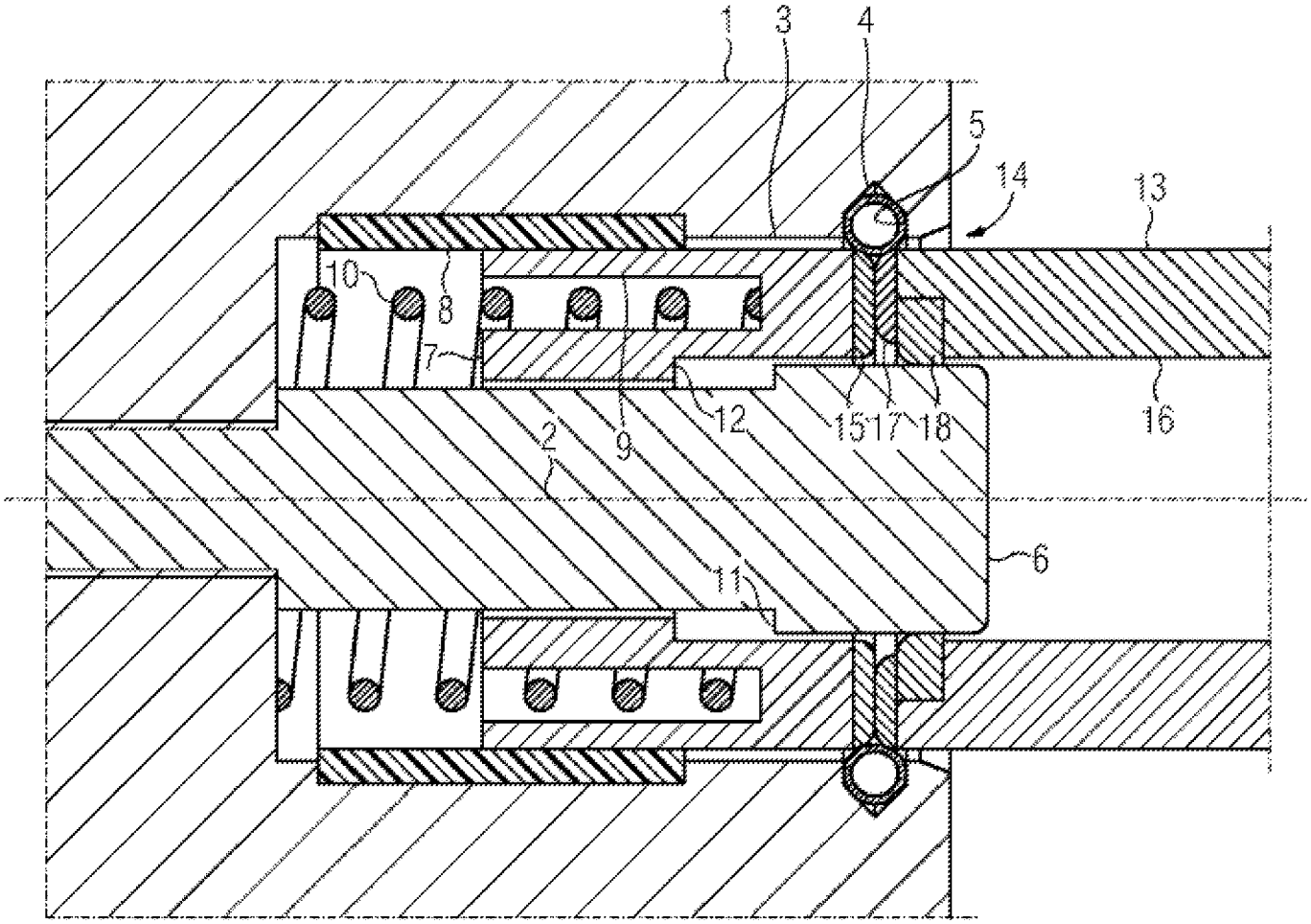
FIG. 2 shows a time during movement of the second contact piece into a contact socket in the first contact piece.

FIG. 2 shows further progress of the relative movement between a first contact piece 1 and a second contact piece 13. FIG. 2 shows the moment at which the contact arrangement 5 makes direct electrical contact with both the auxiliary contact piece 7 and the second contact piece 13. At this moment, the current path between the first and the second contact pieces 1, 13 with the interposed auxiliary contact piece 7 is switched to direct contact between the first contact piece 1 and the second contact piece 13 via the contact arrangement 5, with the auxiliary contact piece 7 removed. Because of the electrically isolating guidance of the auxiliary contact piece 7 by means of the insulating arrangement 8, parallel current paths to the contact, which is formed via the contact arrangement 5, between the first and second contact pieces 1, 13 in the mechanical guidance is prevented.

As can also be seen from FIG. 2, the guidance element 18 moves onto the outer casing surface of the guide element 6, and the second contact element 13 is supported and stabilized on the guide element 6 via the guidance element 18 and the guide socket 16. This makes it harder for the two contact pieces 1, 13 to be tilted or canted with respect to one another. As the relative movement between the first and second contact pieces 1, 13 progresses, the auxiliary contact piece 7 is moved further along the longitudinal axis 2 in the direction of the base of the contact socket 3. As FIG. 2 shows, once the auxiliary contact piece 7 has been moved through the second contact piece 13, the shoulders 11, 12 of the guide element 6 and the auxiliary contact piece 7 are disconnected. The shoulders 11, 12 are disconnected at a time before the auxiliary contact piece 7 is removed from the current path between the first and second contact pieces 1, 13. The auxiliary contact piece 7 and the guide element 6 are galvanically isolated from one another, and are electrically isolated from one another via an annular gap which is located between the guide element 6 and the auxiliary contact piece 7. The movement of the auxiliary contact piece 7 is therefore guided exclusively via the insulating arrangement 8. The guide element 6 merely represents a stop for the auxiliary contact piece 7, in order to limit the movement of the auxiliary contact piece 7 in the contact socket 3. As the relative movement of the first and second contact pieces 1, 13 progresses further, the spring 10 is also further compressed.

Figure 3:
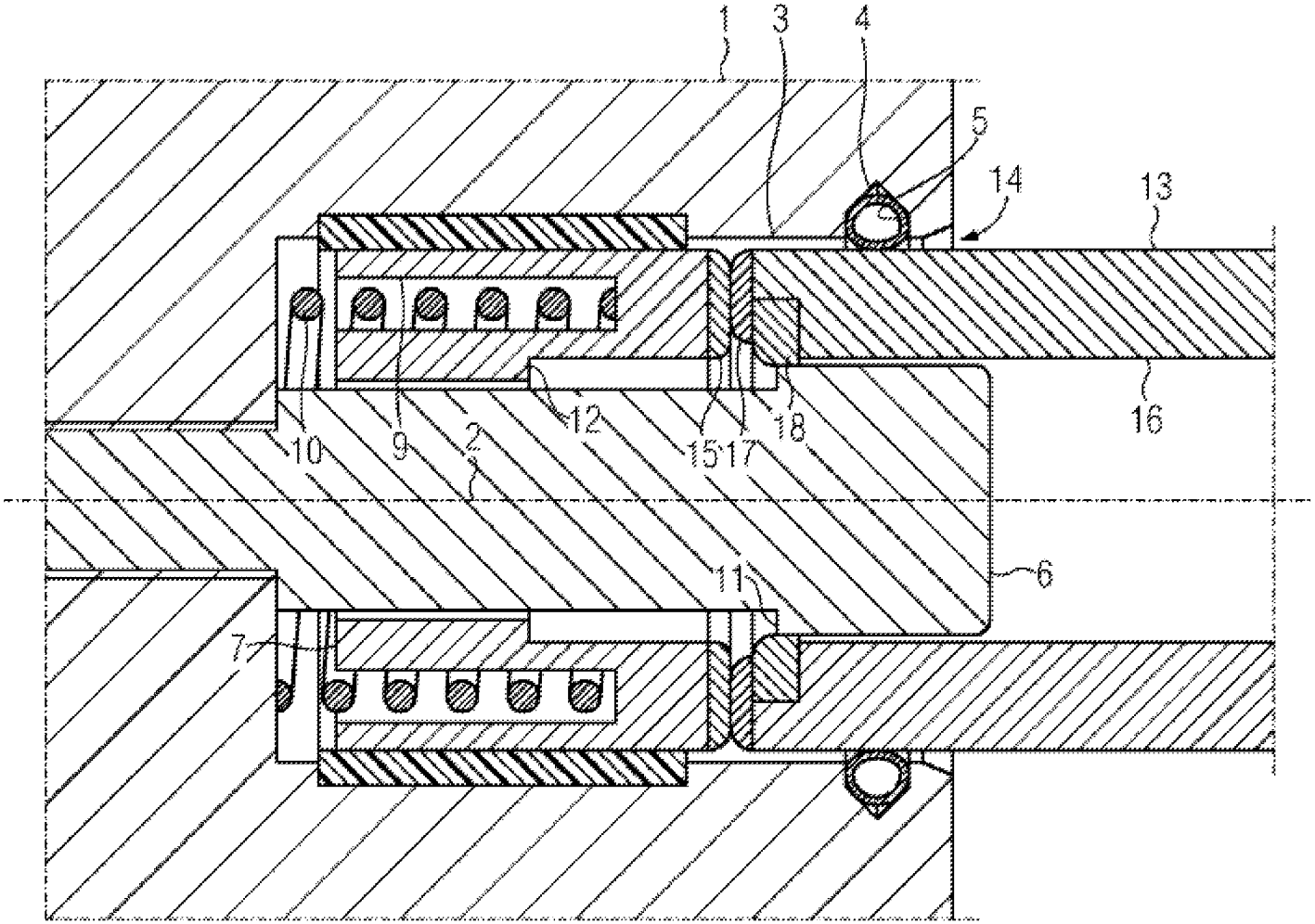
FIG. 3 shows a limit position of the second contact piece, which has been moved into the contact socket in the first contact piece.

FIG. 3 now shows the first switching contact piece 1 and the second switching contact piece 13 in the "closed" switching state (connected state), that is to say the auxiliary contact piece 7 has been moved to its limit position in the contact socket 3 by means of the second contact piece 13. The auxiliary contact piece 7 is guided in the insulating arrangement 8 in an electrically isolated manner. A direct electrical contact is made between the first and the second contact pieces 1, 13 via the contact arrangement 5, which is located in the groove 4 in the contact socket 3. When the electrical contact arrangement is in the connected state, the auxiliary contact piece 7 is no longer part of the electrical current path between the first and second contact pieces 1, 13. Because of the conductive contact between the annular contact-making area 15 on the auxiliary contact piece 7 and the annular contact-pressure area 17 on the second contact piece 13, the auxiliary contact piece 7 is at the same electrical potential as the first contact piece 1 and the second contact piece 13. Because of the electrically isolating guidance of the auxiliary contact piece 7, however, parallel current paths to the current path, which is formed by the contact arrangement 5, between the first and second contact pieces 1, 13 via the mechanical guidance is prevented.

Starting from the state illustrated in FIG. 3, the sequence of the relative movements as described above and as shown in FIGS. 3, 2, 1 is reversed in order to disconnect a contact between the first contact piece 1 and the second contact piece 13. The second contact piece 13 is moved away from the first contact piece 1. The auxiliary contact piece 7 is moved because of the spring loading. Furthermore, the electrically conductive connection is switched from direct contact between the first contact piece 1 and the second contact piece 13 to indirect contact between the two contact pieces 1, 13 with the interposition of the auxiliary contact piece 7, until the first contact piece 1 is electrically disconnected from the second contact piece 13, in which case, arcing phenomena occur on the auxiliary contact piece 7 as a result of the annular contact-making area 15 on the auxiliary contact piece 17 projecting out of the socket opening 14 of the contact socket 3 at the end, thus protecting the first contact piece 1 against such phenomena.

The invention claimed is:

1. An electrical contact configuration, comprising:
- a first contact piece having a contact socket;
- a second contact piece movable relative to and having a shape complementary to said first contact piece;
- an auxiliary contact piece guided in an electrically isolated manner for movement in said contact socket and
- a contact configuration through which said auxiliary contact piece makes electrically conductive contact with said first contact piece, at least in a disconnected state of said first and second contact pieces.

2. The electrical contact configuration according to claim 1, which further comprises an insulating configuration held by said contact socket, said auxiliary contact piece being guided in said insulating configuration.

3. The electrical contact configuration according to claim 1, wherein said contact configuration makes direct contact with said auxiliary contact piece or with said second contact piece, depending on a switching state of the electrical contact configuration.

4. The electrical contact configuration according to claim 1, wherein:
- said second contact piece has an annular contact-pressure area; and
- said auxiliary contact piece has an annular contact-making area having a shape complementary to said annular contact-pressure area.

5. The electrical contact configuration according to claim 1, wherein said auxiliary contact piece and said second contact piece have mutually touching areas with an erosion-resistant coating.

6. The electrical contact configuration according to claim 1, wherein said contact configuration is an elastically deformable contact ring guided in a groove in said contact socket.

7. An electrical contact configuration, comprising:
- a first contact piece having a contact socket;
- a second contact piece movable relative to and having a shape complementary to said first contact piece;
- an auxiliary contact piece guided in an electrically isolated manner for movement in said contact socket;
- a guide element passing through said auxiliary contact piece and limiting a movement capability of said auxiliary contact piece; and
- a spring, said auxiliary contact piece being spring-loaded and having an annular groove for holding said spring.

8. The electrical contact configuration according to claim 7, wherein said annular groove surrounds said guide element.

9. The electrical contact configuration according to claim 7, wherein said second contact piece has a guide socket configured to move onto said guide element during a connection process.

10. The electrical contact configuration according to claim 9, wherein said guide socket has a radially projecting guidance element.

11. An electrical contact configuration, comprising:
- a first contact piece having a contact socket;
- a second contact piece movable relative to and having a shape complementary to said first contact piece; and
- an auxiliary contact piece guided in an electrically isolated manner for movement in said contact socket, said auxiliary contact piece closing said contact socket.

12. An electrical contact configuration, comprising:
- a first contact piece having a contact socket;
- a second contact piece movable relative to and having a shape complementary to said first contact piece;
- an auxiliary contact piece guided in an electrically isolated manner for movement in said contact socket; and
- a guide element passing through said auxiliary contact piece and limiting a movement capability of said auxiliary contact piece;
- said auxiliary contact piece together with said guide element closing said contact socket.

* * * * *